United States Patent [19]

Scuderi

[11] 3,946,890

[45] Mar. 30, 1976

[54] CHILD PROOF CLOSURE

[76] Inventor: Vincent Scuderi, 84 Robbins Drive, East Williston, N.Y.

[22] Filed: June 9, 1975

[21] Appl. No.: 584,735

Related U.S. Application Data

[63] Continuation-in-part of Ser. No. 548,907, Feb. 11, 1975.

[52] U.S. Cl. ..... 215/220

[51] Int. Cl.[2] B65D 55/02; B65D 55/56; A61H 1/00

[58] Field of Search..... 215/9, 219, 220

[56] References Cited

UNITED STATES PATENTS 3,853,236 12/1974 Ostrowsky ..... 215/220

3,878,961 4/1975 Curry et al..... 215/219

*Primary Examiner*—George T. Hall

*Attorney, Agent, or Firm*—James P. Malone

[57] ABSTRACT

A child proof closure for containers having a threaded neck. A screw type cap has a first set of teeth mounted on its side the teeth being set at an angle to the axis of the cap. A drive member is loosely mounted on the cap for limited axial motion. A second set of teeth is mounted on said drive member, the teeth being angled in the same direction as the first set of teeth. When said drive member is turned in the direction to remove the cap, the interaction of said teeth lifts the drive member relative to the cap and the first and second sets of teeth disengage so that the cap cannot be removed soley by turning.

2 Claims, 3 Drawing Figures

CHILD PROOF CLOSURE

This application is a Continuation-in-Part of my prior application Ser. No. 548,907 filed Feb. 11, 1975, for Child Proof Closure.

This invention relates to child proof closures for containers containing medicines, poisons and corrosive substances or liquids.

This invention provides a cap means which must be pressed down and turned in order to remove the cap. This invention is preferably made from plastic.

In my prior application, the drive member fit over the top portion of the cap. In this invention the drive member fits over the entire cap. This provides a longer side wall with greater flexibility and is more suitable for plastic construction Accordingly, a principal object of the invention is to provide new and improved means for child proof closures for containers.

Another object of the invention is to provide new and improved means for child proof closures for containers of the type having a threaded neck.

Another object of the invention is to provide new and improved screw type closures for containers such as bottles which require simultaneous pressing and turning in order to unscrew the cap.

Another object of the invention is to provide a new and improved screw type cap having a drive member loosely mounted on the cap wherein both the cap and the drive member have teeth which must be engaged by firmly pressing the drive member onto the cap and simultaneously turning in order to unscrew the cap.

Another object of the invention is to provide new and improved child proof closure means for containers having a threaded neck comprising, a screw type cap having a lower outwardly extending lip, a first set of teeth on the side of said cap, said teeth being set at an angle to the axis of said cap, a drive member loosely mounted on said cap for limited axial motion, said drive member having an interior slot around its lower periphery said slot engaging said lip so as to permit axial movement of said drive member on said cap, a second set of teeth on said drive member, said teeth being angled in the same direction as said first set of teeth, whereby when said drive member is turned in the direction to remove the cap, the interaction of said teeth lifts the drive member relative to the cap and the first and second sets of teeth disengage so that the cap cannot be removed solely by turning.

These and other objects of the invention will be apparent from the following specification and drawings of which:

Figures 1, 2:
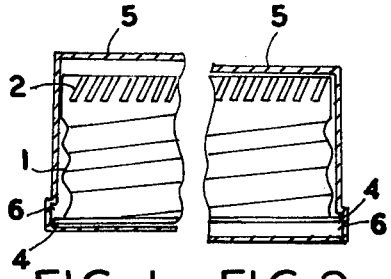
FIG. 1 is a side view of an embodiment of the invention partially in section, in free position.
FIG. 2 is a side view of the embodiment of FIG. 1 partially in section, in engaged position.
Figure 3:
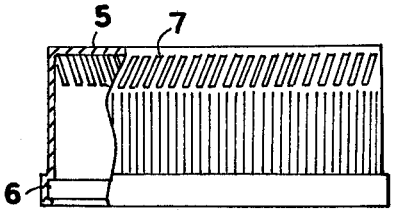
FIG. 3 is a side view of the drive member of FIG. 1.

Referring to the Figures, the cap 1 is a screw type cap which is adapted to be screwed onto a container such as medicine bottles, of the type which have a threaded neck. The cap is conventional except for two features. First the cap has a plurality of teeth 2, which are mounted on the upper side of the cap, and secondly, the cap has an annular lip 4 on the lower periphery, one purpose of which is to loosely retain the drive member 5, on cap 1. The teeth 2 have an angle to the axis of the cap in the neighborhood of 45° to 60°.

The drive member 5, has an interior lower slot 6, which is adapted to fit onto the lip 4, so as to hold the drive member on the cap, but free to move axiably and rotatably. The drive member has a circle of teeth 7, on the interior of its upper surface which are adapted to mate with the teeth 2, of the cap 1, when the drive member is pressed on the cap.

The teeth 7, have an angle to the axis equal to that of the angle of the teeth 2. The direction of the angle is chosen so that the lower edges of the teeth lead in the direction that the cap is turned to apply it. When the drive member is turned clockwise to apply the cap, then the first and second sets of teeth, 2 and 7, lock together.

On the other hand, when the drive member is turned counterclockwise, in the direction to remove the cap without pressing, the interaction of the teeth causes the drive member to lift away from the cap so that the teeth are not engaged but the drive member teeth slip over the cap teeth. There is sufficient play in the mounting of the drive member between lip and slot 6 to accommodate this axial motion of the drive member.

When it is desired to remove the cap, the drive member is pressed down firmly onto the cap and rotated counter-clockwise. The pressing will cause the first and second sets of teeth 2 and 7, to remain in contact so that by simultaneously pressing and turning counterclockwise the cap can be removed. The teeth are not formed with square cross-sections but are of a curved cross-section so that a first pressing is required to keep the teeth in contact for the purpose of removing the cap.

The drive member is mounted on the cap and the dimensions are such that the drive member is retained loosely on the cap so that it can be easily turned without turning the cap, as shown in FIG. 1.

Therefore, a child merely turning the drive member will not unscrew the cap. The teeth are pointed or beveled with rounded edges so that a firm pressure is required to hold them into engagement when unscrewing the cap.

It is unlikely that a small child would be able to appreciate that it is necessary to press and turn simultaneously to unscrew the cap. Furthermore, since the teeth are not square, a small child would not have sufficient strength to hold the teeth in engagement while unscrewing the cap.

The cap and drive member are preferably made of molded plastic. The drive member has sufficient flexibility to that it may be snapped into position on the cap and thereafter cannot be removed.

I claim:

1. A child proof closure for containers having a threaded neck comprising:

a screw type cap, having a lower outwardly extending lip, a first set of teeth on the side of said cap, said teeth being set at an angle to the axis of said cap, a drive member loosely mounted on said cap for limited axial motion, said drive member having an interior slot around its lower periphery said slot engaging said lip so as to permit axial movement of said drive member on said cap, a second set of teeth on said drive member, said teeth being angled in the same direction as said first set of teeth, whereby when said drive member is turned in the direction to remove the cap, the interaction of said teeth lifts the drive member relative to the cap and the first and second sets of teeth disengage so that the cap cannot be removed solely by turning.

2. Apparatus as in claim 1, wherein said first and second sets of teeth are set at an angle to the axis of said cap so that the leading lower edges of the teeth are in the direction of turning said cap to apply the cap to the container.

* * * * *

UNITED STATES PATENT OFFICE

CERTIFICATE OF CORRECTION

Patent No. 3,946,890 Dated March 30, 1976

Inventor(s) Vincent Scuderi

It is certified that error appears in the above-identified patent and that said Letters Patent are hereby corrected as shown below:

Column 2, line 30, delete "first" and insert -- firm --.

Signed and Sealed this

Tenth Day of August 1976

[SEAL]

*Attest:*

RUTH C. MASON
*Attesting Officer*

C. MARSHALL DANN
*Commissioner of Patents and Trademarks*